US005896852A

United States Patent [19]

Hu et al.

[11] Patent Number: 5,896,852

[45] Date of Patent: Apr. 27, 1999

[54] CHEMICAL REACTANT BOTTLE AND METHOD OF USE THEREOF

[75] Inventors: Tain Chen Hu, Ping-Tung; Philip Jan Lin, Taipei; Chang-Yueh Wu, Hsin-Chu, all of Taiwan

[73] Assignee: Taiwan Semiconductor Manufacturing Company, Ltd., Hsin-Chu, Taiwan

[21] Appl. No.: 08/714,737

[22] Filed: Sep. 16, 1996

[51] Int. Cl.[6] ..... F24J 1/00

[52] U.S. Cl. ..... 126/263.01; 422/102

[58] Field of Search ..... 62/4, 457; 126/262, 126/263.01; 422/102

[56] References Cited

U.S. PATENT DOCUMENTS

| | | | |
|---|---|---|---|
| 2,470,806 | 5/1949 | Del Cueto | 219/43 |
| 4,232,532 | 11/1980 | Marsh | 62/457 |
| 4,450,878 | 5/1984 | Takada et al. | 141/48 |
| 4,597,435 | 7/1986 | Fosco, Jr. | 62/457 |
| 4,739,963 | 4/1988 | Parmacek et al. | 249/61 |
| 5,653,943 | 8/1997 | Arnold | 422/102 |

*Primary Examiner*—Henry A. Bennett
*Assistant Examiner*—Gregory A. Wilson
*Attorney, Agent, or Firm*—George O. Saile; Stephen B. Ackerman; Graham S. Jones, II

[57] ABSTRACT

A chemical reactant bottle for containing a chemical reactant is adapted for heat transfer with an ambient fluid. The bottle has a body including a top and a bottom and sidewalls between the top and the bottom of the bottle. The top and the bottom and the sidewalls define a cavity within the bottle. There is an opening through the top into the cavity at one end of the bottle. The bottle includes a plurality of external slots extending through the body parallel with the longitudinal axis. The slots extend between the sidewalls of the bottle to create additional contact surface with the ambient fluid.

18 Claims, 2 Drawing Sheets

CHEMICAL REACTANT BOTTLE AND METHOD OF USE THEREOF

BACKGROUND OF THE INVENTION

1. Field of the Invention

This invention relates to a bottle with a cap and more particularly to a bottle with heat transfer slots in the bottle, and a method of heating a chemical reactant in the bottle.

2. Description of Related Art

Room temperature warming of chemical fluid is required before use to avoid particle generation during spin-on coating of Spin-on-Glass (SOG). Current bottle designs introduce temperature gradients of SOG fluid within the bottle and tending to cause generation of particles which will introduce defects into the products.

U.S. Pat. No. 4,739,963 of Parmacek et al for "Ice Molds" shows an ice mold bottle with an open central region so that cooling can be uniformily done, but the present invention's design is for a different purpose and design.

U.S. Pat. No. 2,470,806 of Del Cueto for "Device for Heating, Cooling, or Radiating Liquids" shows a glass or quartz bottle having a central hollow space or tunnel extending up from the bottom to cool or heat evenly the contents with the central hollow space having an opening at the bottom. "The hollow space may be closed at its upper end . . . at any convenient distance from the bottom of the container or it may be opened at both ends, being understood in the latter embodiment . . . the container will have a laterally located lidded opening . . . "

SUMMARY OF THE INVENTION

An object of this invention is to minimize warm-up period of SOG before use, i.e reduce lead time.

Another object of this invention is to maximize heat transfer allowing faster thermal equilibrium of contained chemical fluid.

Still another object of this invention is to provide a bottle design permitting larger chemical bottles adapted to be cooled/warmed which minimizes frequent bottle changes and effectively reduce machine downtime.

A further object of this invention is to provide thermal equilibrium of chemical fluid, combined with suitable bottle material to effectively minimize the chance of precursor flocking, precipitation, and particle generation due to temperature gradients that exist between various regions within the bottle.

In accordance with this invention, there are open slots in the bottle to create additional contact surface area to ambient.

In accordance with this invention, a method is provided for heating spin-on glass in a reactant bottle adapted for containing a chemical reactant, the bottle being adapted for heat transfer with an ambient fluid. The method comprises providing a bottle with a body including a top and a bottom and sidewalls between the top and the bottom of the bottle, the top and the bottom and the sidewalls defining a cavity within the bottle, the bottle including an opening through the top into the cavity at one end of the bottle, the bottle including at least one external slot extending through the body between the sidewalls of the bottle to create additional contact surface with the ambient fluid. Then place a spin-on-glass fluid within the bottle, place the bottle in the ambient fluid, and heat the bottle with heat in the ambient fluid through the body of the bottle including the slot.

Preferably, the bottle includes the slot extending lengthwise of the bottle; where it is preferred that the bottle includes a pair of the slots formed in a parallel array extending lengthwise of the bottle.

In accordance with another aspect of this invention a method is provided for heating spin-on-glass in a chemical reactant bottle, the bottle being adapted for heat transfer with an ambient fluid. The method comprises providing a bottle having a body including a top and a bottom with a longitudinal axis between the top and the bottom and sidewalls parallel with the longitudinal axis, the sidewalls extending between the top and the bottom of the bottle, the top and the bottom and the sidewalls defining a cavity within the bottle, an opening through the top into the cavity at one end of the bottle, a cap for the bottle adapted to be secured and to be sealed to the bottle at the opening, the bottle including a plurality of parallel external heat transfer slots, the slots extending through the body between the sidewalls of the bottle and the slots extending parallel to the longitudinal axis of the bottle, the slots being adapted to create additional contact surface with the ambient fluid. Then place a spin-on-glass fluid within the bottle, place the bottle in the ambient fluid, and heat the bottle with heat in the ambient fluid through the body of the bottle including the slot.

Preferably, the bottle includes slots extending lengthwise of the bottle; and it is preferred that the slots are formed in a parallel array extending lengthwise of the bottle.

In accordance with still another aspect of this invention a method is provided for heating a chemical reactant in a bottle adapted for containing a chemical reactant. The bottle is adapted for heat transfer with an ambient fluid. The bottle includes providing a bottle having a body including a top and a bottom and sidewalls between the top and the bottom of the bottle, the top and the bottom and the sidewalls defining a cavity within the bottle with an opening through the top into the cavity at one end of the bottle, a cap for the bottle adapted to be secured and to be sealed to the bottle at the opening, the bottle including a plurality of external slots extending through the body parallel with the longitudinal axis and the slots extending between the sidewalls of the bottle to create additional contact surface with the ambient fluid. Then place a spin-on-glass fluid within the bottle, place the bottle in the ambient fluid, and heat the bottle through the body of the bottle including the slot.

Preferably, the bottle includes slots extending lengthwise of the bottle; and it is preferred that the slots are formed in a parallel array extending lengthwise of the bottle.

In accordance with another aspect of the invention, a chemical reactant bottle is provided adapted for containing a chemical reactant, the bottle being adapted for heat transfer with an ambient fluid. The bottle has a body including a top and a bottom and sidewalls between the top and the bottom of the bottle. The top and the bottom and the sidewalls define a cavity within the bottle. There is an opening through the top into the cavity at one end of the bottle. The bottle includes at least one external slot extending through the body between the sidewalls of the bottle to create additional contact surface with the ambient fluid whereby the slot through the bottle creates additional contact surface with the ambient fluid.

Preferably, the bottle includes slots extending lengthwise of the bottle; and it is preferred that the slots are formed in a parallel array extending lengthwise of the bottle.

In accordance with still another aspect of the invention, a chemical reactant bottle in accordance with this invention is adapted for containing a chemical reactant, the bottle being adapted for heat transfer with an ambient fluid. The bottle has a body including a top and a bottom with a longitudinal axis between the top and the bottom and sidewalls parallel with the longitudinal axis, the sidewalls extending between the top and the bottom of the bottle. The top and the bottom and the sidewalls define a cavity within the bottle. There is an opening through the top into the cavity at one end of the bottle with a cap for the bottle adapted to be secured and to be sealed to the bottle at the opening. The bottle includes a plurality of parallel external heat transfer slots, the slots extending through the body between the sidewalls of the bottle and the slots extending parallel to the longitudinal axis of the bottle, the slots being adapted to create additional contact surface with the ambient fluid, whereby the slot through the bottle creates additional contact surface with the ambient fluid.

Preferably, the bottle includes slots extending lengthwise of the bottle; and it is preferred that the slots are formed in a parallel array extending lengthwise of the bottle.

In accordance with a further aspect of the invention, a chemical reactant bottle is adapted for containing a chemical reactant. The bottle is also adapted for heat transfer with an ambient fluid. The bottle has a body including a top and a bottom and sidewalls between the top and the bottom of the bottle. The top and the bottom and the sidewalls define a cavity within the bottle. There is an opening through the top into the cavity at one end of the bottle, and a cap for the bottle adapted to be secured and to be sealed to the bottle at the opening. The bottle includes a plurality of external slots extending through the body parallel with the longitudinal axis and the slots extending between the sidewalls of the bottle to create additional contact surface with the ambient fluid, whereby the slots through the bottle create additional contact surfaces with the ambient fluid.

Preferably, the bottle includes slots extending lengthwise of the bottle; and it is preferred that the slots are formed in a parallel array extending lengthwise of the bottle.

BRIEF DESCRIPTION OF THE DRAWINGS

The foregoing and other aspects and advantages of this invention are explained and described below with reference to the accompanying drawings, in which.

DESCRIPTION OF THE PREFERRED EMBODIMENT

Figure 1B:
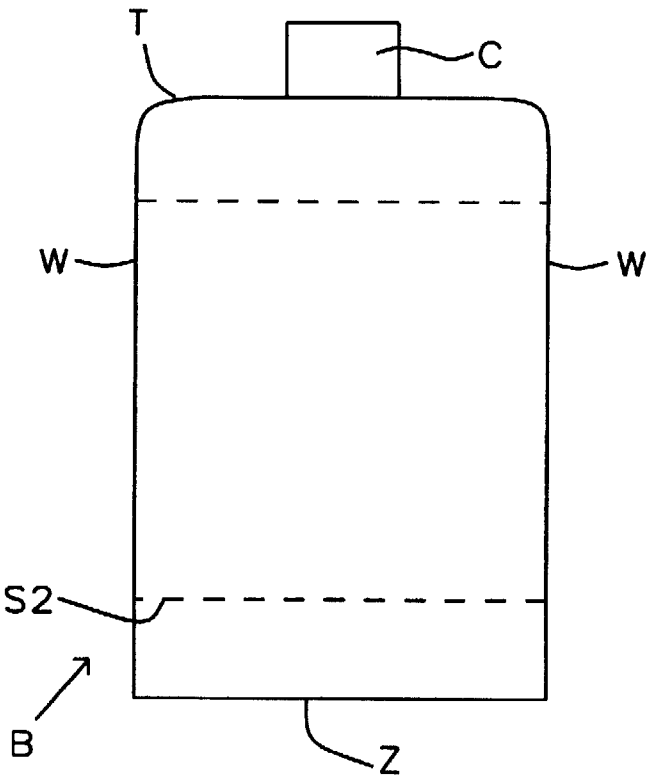
FIG. 1B shows the right elevation of the bottle of FIG. 1A with the slot S2 extending from left to right (front to back in FIG. 1A).
Figure 1A:
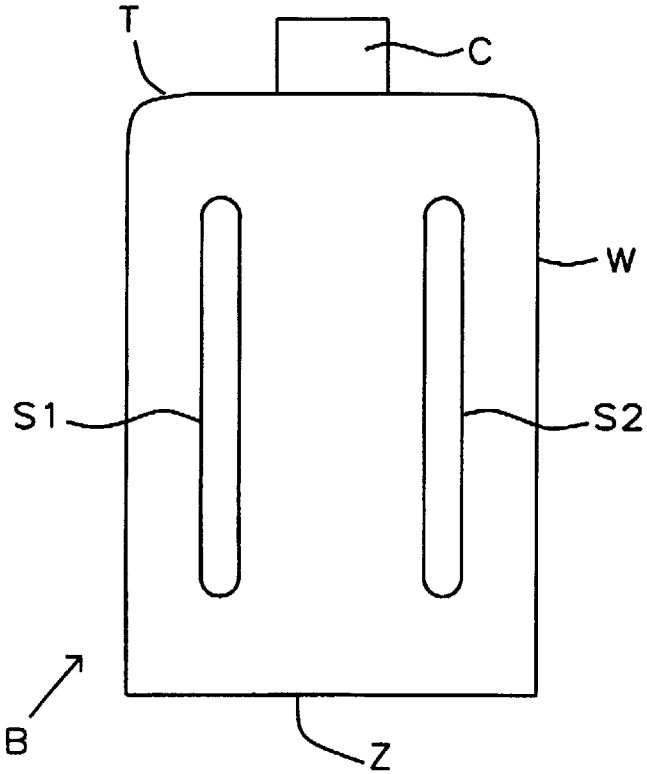
FIG. 1A and shows a chemical reactant bottle B adapted for containing a chemical reactant.
Figure 1C:
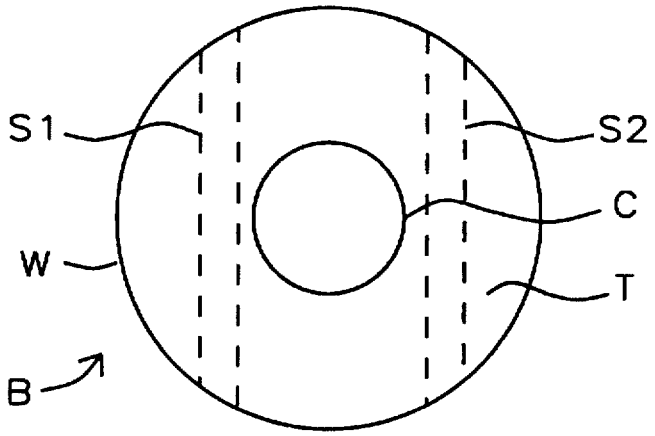
FIG. 1C shows a top view of the device of FIG. 1A showing how the slots S1 and S2 extend through the bottle B.
Figure 2:
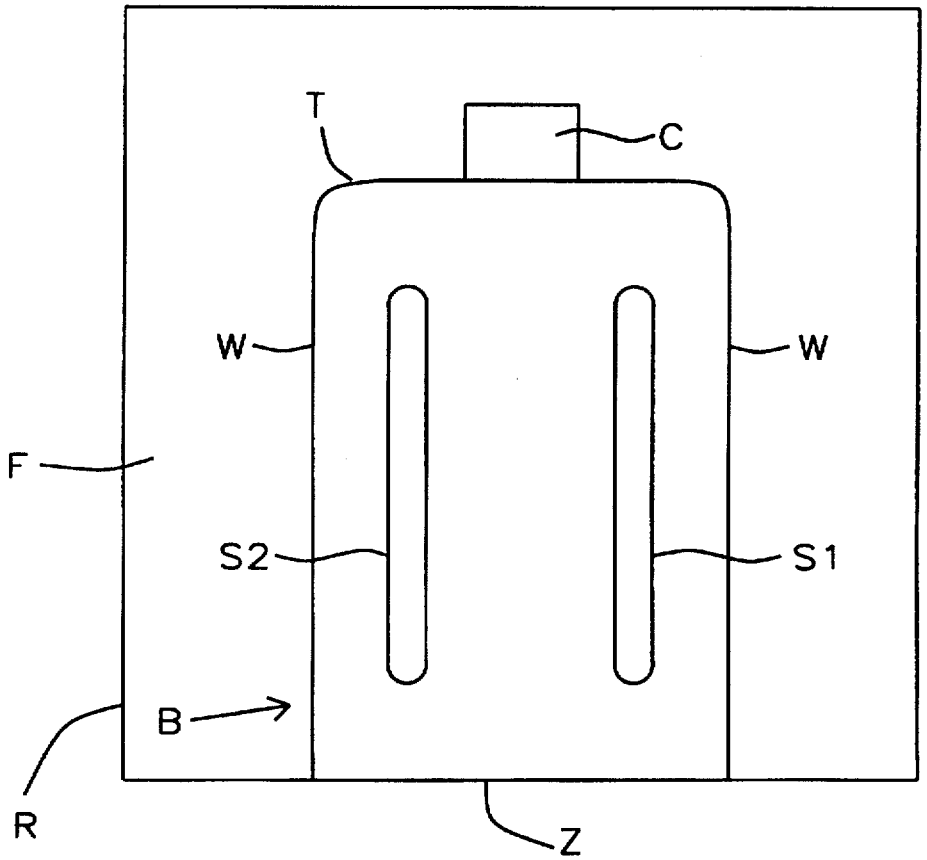
FIG. 2 shows the bottle of FIG. 1 located in an ambient fluid in a reservoir.

FIGS. 1A show a chemical reactant bottle B adapted containing a chemical reactant. FIG. 2 shows the bottle of FIG. 1 located in a reservoir R in an ambient fluid F. The bottle B is adapted for heat transfer with the ambient fluid F. The bottle B includes a body formed with external walls W sides thereof. The bottle B has a top T and a bottom Z and sidewalls W between the top T and the bottom Z. The top T, bottom B and the sidewalls W define a hollow cavity within the bottle B. There is an opening into the cavity at the top end T of the bottle B. A cap C covers that opening into the cavity of the bottle B. Cap C is adapted to be secured to the bottle and to be sealed to the bottle B at the opening by a means such as a threaded seal or a snap seal.

For the purpose of enhanced heat transfer, the bottle B includes two external, vertically extending slots S1 and S2 parallel to the vertical axis of the bottle B. Slots S1 and S2 extend in a parallel array extending lengthwise of the bottle B. The slots S1 and S2 extend through the body B between the sidewalls W of the bottle B to create additional contact surface with an ambient fluid for the purpose of enhancing the rate of heat transfer between the fluid F in FIG. 2 and the contents of the cavity in the bottle B. The slots S1 and S2 through the bottle B create additional contact surface of the external surface of bottle B with the ambient fluid surrounding the exterior of the bottle B.

FIG. 1B shows the right elevation of the bottle of FIG. 1A with the slot S2 extending from left to right (front to back in FIG. 1A). FIG. 1C shows a top view of the device of FIG. 1A showing how the slots S1 and S2 extend through the bottle B.

FIG. 2 shows the reservoir R with the bottle B in fluid F which passes through the slots S1 and S2 to enhance the cooling or heating effect from the fluid F.

The walls W, top T and bottom Z of the bottle B are composed of thermally conductive materials for uniform cooling/warming of contained chemical fluid.

SUMMARY

1. Slots are opened through the bottle to create additional contact surface with the ambient.
2. The additional surface will help dissipate or absorb heat so that a faster thermal equilibrium can be reached, much faster than the case when no such slots exist.
3. Due to such faster thermal equilibrium, temperature gradient across the bottle are minimized or eliminated in a way such that the material quality within the bottle remains the same.
4. Thermal equilibrium of chemical fluid, combined with suitable bottle material, can effectively minimize the chance of precursor flocking, precipitation, and particle generation due to temperature gradients that exist between various regions within the bottle.

While this invention has been described in terms of the above specific embodiment(s), those skilled in the art will recognize that the invention can be practiced with modifications within the spirit and scope of the appended claims, i.e. that changes can be made in form and detail, without departing from the spirit and scope of the invention. Accordingly all such changes come within the purview of the present invention and the invention encompasses the subject matter of the claims which follow.

Having thus described the invention, what is claimed as new and desirable to be secured by Letters Patent is as follows:

1. A method of heating spin-on glass in a reactant bottle adapted for containing a chemical reactant, said bottle being adapted for heat transfer with an ambient fluid, said method comprising:

providing a bottle within a body including a top and a bottom and sidewalls between said top and said bottom of said bottle, said top and said bottom and said sidewalls defining a cavity within said bottle, said bottle including an opening through said top into said cavity at one end of said bottle, said bottle including at least one external slot extending through said body between said sidewalls of said bottle to create additional contact surface with said ambient fluid, placing a spin-on-glass fluid within said bottle, placing said bottle in said ambient fluid, and heating said bottle with heat in said ambient fluid through said body of said bottle including said slot.

2. A method in accordance with claim 1 wherein said bottle includes said slot extending lengthwise of said bottle.

3. A method in accordance with claim 1 wherein said bottle includes a pair of said slots are formed in a parallel array extending lengthwise of said bottle.

4. A method for heating spin-on glass in a chemical reactant bottle, said bottle being adapted for heat transfer with an ambient fluid, said method comprising:

providing a bottle having a body including a top and a bottom with a longitudinal axis between said top and said bottom and sidewalls parallel with said longitudinal axis, said sidewalls extending between said top and said bottom of said bottle, said top and said bottom and said sidewalls defining a cavity within said bottle, an opening through said top into said cavity at one end of said bottle, a cap for said bottle adapted to be secured and to be sealed to said bottle at said opening, said bottle including a plurality of parallel external heat transfer slots, said slots extending through said body between said sidewalls of said bottle and said slots extending parallel to said longitudinal axis of said bottle, said slots being adapted to create additional contact surface with said ambient fluid, placing a spin-on-glass fluid within said bottle, placing said bottle in said ambient fluid, and heating said bottle with heat in said ambient fluid through said body of said bottle including said slot.

5. A method in accordance with claim 4 wherein said bottle includes said slots extending lengthwise of said bottle.

6. A method in accordance with claim 4 wherein said slots are formed in a parallel array extending lengthwise of said bottle.

7. A method of heating a chemical reactant in a bottle adapted for containing a chemical reactant, said bottle being adapted for heat transfer with an ambient fluid, said bottle including:

providing a bottle having a body including a top and a bottom and sidewalls between said top and said bottom of said bottle, said top and said bottom and said sidewalls defining a cavity within said bottle, an opening through said top into said cavity at one end of said bottle, a cap for said bottle adapted to be secured and to be sealed to said bottle at said opening, said bottle including a plurality of external slots extending through said body parallel with said longitudinal axis and said slots extending between said sidewalls of said bottle to create additional contact surface with said ambient fluid, placing a spin-on-glass fluid within said bottle, placing said bottle in said ambient fluid, and heating said bottle with heat in said ambient fluid through said body of said bottle including said slot.

8. A method in accordance with claim 7 wherein said bottle includes said slot extending lengthwise of said bottle.

9. A method in accordance with claim 7 wherein said bottle includes a pair of said slots are formed in a parallel array extending lengthwise of said bottle.

10. A chemical reactant bottle adapted for containing a chemical reactant, said bottle being adapted for heat transfer with an ambient fluid, said bottle including:

said bottle having a body including a top and a bottom and sidewalls between said top and said bottom of said bottle, said top and said bottom and said sidewalls defining a cavity within said bottle, an opening through said top into said cavity at one end of said bottle, said bottle including at least one external slot extending through said body between said sidewalls of said bottle to create additional contact surface with said ambient fluid, whereby said slot through said bottle creates additional contact surface with said ambient fluid.

11. A bottle in accordance with claim 10 wherein said bottle includes said slot extending lengthwise of said bottle.

12. A bottle in accordance with claim 10 wherein said bottle includes a pair of said slots are formed in a parallel array extending lengthwise of said bottle.

13. A chemical reactant bottle adapted for containing a chemical reactant, said bottle being adapted for heat transfer with an ambient fluid, said bottle including:

said bottle having a body including a top and a bottom with a longitudinal axis between said top and said bottom and sidewalls parallel with said longitudinal axis, said sidewalls extending between said top and said bottom of said bottle, said top and said bottom and said sidewalls defining a cavity within said bottle, an opening through said top into said cavity at one end of said bottle, a cap for said bottle adapted to be secured and to be sealed to said bottle at said opening, said bottle including a plurality of parallel external heat transfer slots, said slots extending through said body between said sidewalls of said bottle and said slots extending parallel to said longitudinal axis of said bottle, said slots being adapted to create additional contact surface with said ambient fluid, whereby said slot through said bottle creates additional contact surface with said ambient fluid.

14. A bottle in accordance with claim 13 wherein said bottle includes said slots extending lengthwise of said bottle.

15. A bottle in accordance with claim 13 wherein said slots are formed in a parallel array extending lengthwise of said bottle.

16. A chemical reactant bottle adapted for containing a chemical reactant, said bottle being adapted for heat transfer with an ambient fluid, said bottle including:

said bottle having a body including a top and a bottom and sidewalls between said top and said bottom of said bottle, said top and said bottom and said sidewalls defining a cavity within said bottle, an opening through said top into said cavity at one end of said bottle, a cap for said bottle adapted to be secured and to be sealed to said bottle at said opening, said bottle including a plurality of external slots extending through said body parallel with said longitudinal axis and said slots extending between said sidewalls of said bottle to create additional contact surface with said ambient fluid, whereby said slots through said bottle create additional contact surfaces with said ambient fluid.

17. A bottle in accordance with claim 16 wherein said bottle includes said slot extending lengthwise of said bottle.

18. A bottle in accordance with claim 16 wherein said bottle includes a pair of said slots are formed in a parallel array extending lengthwise of said bottle.

* * * * *